US008845213B2

(12) United States Patent
Cardells et al.

(10) Patent No.: US 8,845,213 B2
(45) Date of Patent: Sep. 30, 2014

(54) METHOD AND SYSTEM TO TRACK UNUSED MEDIA

(75) Inventors: Ana Maria Cardells, Barcelona (ES); Oriol Borrell, Barcelona (ES); Xavier Boix, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 702 days.

(21) Appl. No.: 12/893,899

(22) Filed: Sep. 29, 2010

(65) Prior Publication Data

US 2012/0076514 A1 Mar. 29, 2012

(51) Int. Cl.

| | |
|---|---|
| ***B41J 11/46*** | (2006.01) |
| ***B41J 11/70*** | (2006.01) |
| ***B41J 29/38*** | (2006.01) |
| ***G03G 15/00*** | (2006.01) |

(52) U.S. Cl.

CPC ..... *B41J 11/46* (2013.01); *G03G 15/553* (2013.01); *G03G 2215/00455* (2013.01); *B41J 29/38* (2013.01); *B41J 11/70* (2013.01); *G03G 15/55* (2013.01)

USPC ..... 400/76; 400/613; 400/621; 347/104

(58) Field of Classification Search

USPC ..... 400/613, 621

See application file for complete search history.

(56) References Cited

U.S. PATENT DOCUMENTS

| | | | | | |
|---|---|---|---|---|---|
| 5,938,354 | A * | 8/1999 | Yasui et al. | ..... | 400/621 |
| 6,210,052 | B1 * | 4/2001 | Smith | ..... | 400/62 |
| 6,335,084 | B1 | 1/2002 | Biegelsen et al. | | |
| 6,624,903 | B1 * | 9/2003 | Miquel et al. | ..... | 358/1.12 |
| 2003/0076520 | A1 | 4/2003 | Haines et al. | | |
| 2004/0070784 | A1 * | 4/2004 | Shannon | ..... | 358/1.15 |
| 2006/0125903 | A1 * | 6/2006 | Fogarty et al. | ..... | 347/107 |
| 2007/0236720 | A1 * | 10/2007 | Tamada et al. | ..... | 358/1.14 |
| 2009/0206153 | A1 | 8/2009 | Vetromile et al. | | |

FOREIGN PATENT DOCUMENTS

| | | | | | |
|---|---|---|---|---|---|
| JP | 63317375 | A | | 12/1988 | |
| JP | 6031967 | A | | 2/1994 | |
| JP | 2001105700 | A | * | 4/2001 | ..... B41J 29/48 |
| JP | 2003211796 | A | * | 7/2003 | ..... B41J 29/38 |

* cited by examiner

*Primary Examiner* — Daniel J Colilla

(57) ABSTRACT

In one embodiment, data is discerned, the data indicative of a first quantity of unused media contained within a roll. Prior to a plot being printed on the roll, a second quantity of unused media expected to be in the roll after the plot is printed is discerned using the data. Printing of a machine-readable marking on the roll, along with the plot, is caused, the marking being indicative of the second quantity.

20 Claims, 9 Drawing Sheets

METHOD AND SYSTEM TO TRACK UNUSED MEDIA

BACKGROUND

In certain printing environments, e.g. when printing a banner or other graphic art utilizing a large format printer, the printer may print a plot or a series of plots upon a media supplied by a media roll. Between plots there may be a change of media rolls to switch types, or widths, of media. Often the roll that is being used is not new, i.e. the roll has been used in a previous print job.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

When printing on a media supplied by a roll that has been used in a previous print job, it is desirable to have accurate knowledge as to the amount of media left in the roll. If there is uncertainty as to the amount of unused media left in the roll, a user does not know whether a print job will fit within the amount of media that is left in the roll. This uncertainty can be costly as miscalculation will result in wasted media, wasted consumables (e.g. ink or toner) and wasted time.

One means of reducing this uncertainty is to, at the time of unloading of a media roll, print a marking to be placed on the unloaded media roll. This approach may not be optimal when implemented in some printers, however, due to the amount of time and expense associated with printing the marking. For example, a printer that uses latex inks might need to perform the following steps to print the marking: warm up the printer, print the marking, cure the marking, and cool the printer. A user that needs to change the media quickly to print another plot may find the waiting time involved with this approach to be undesirable. Other types of printers may have alternative or additional overheads relating to starting and stopping the printer. Various embodiments of the present disclosure were developed in an effort to provide a method and a system to track unused media within a roll in a manner that can reduce the time and expense to print the marking, leading to better ease of use and a better customer experience.

The following description is broken into sections. The first, labeled "Environment", describes an example environment in which embodiments may be implemented. The second section, labeled "Components", describes various physical and logical components utilized to implement various embodiments. The third section, labeled as "Operation", describes steps taken to implement various embodiments. The fourth section, labeled "Example", describes an example implementation of the disclosed method and system to track unused media within a roll.

Figure 1:
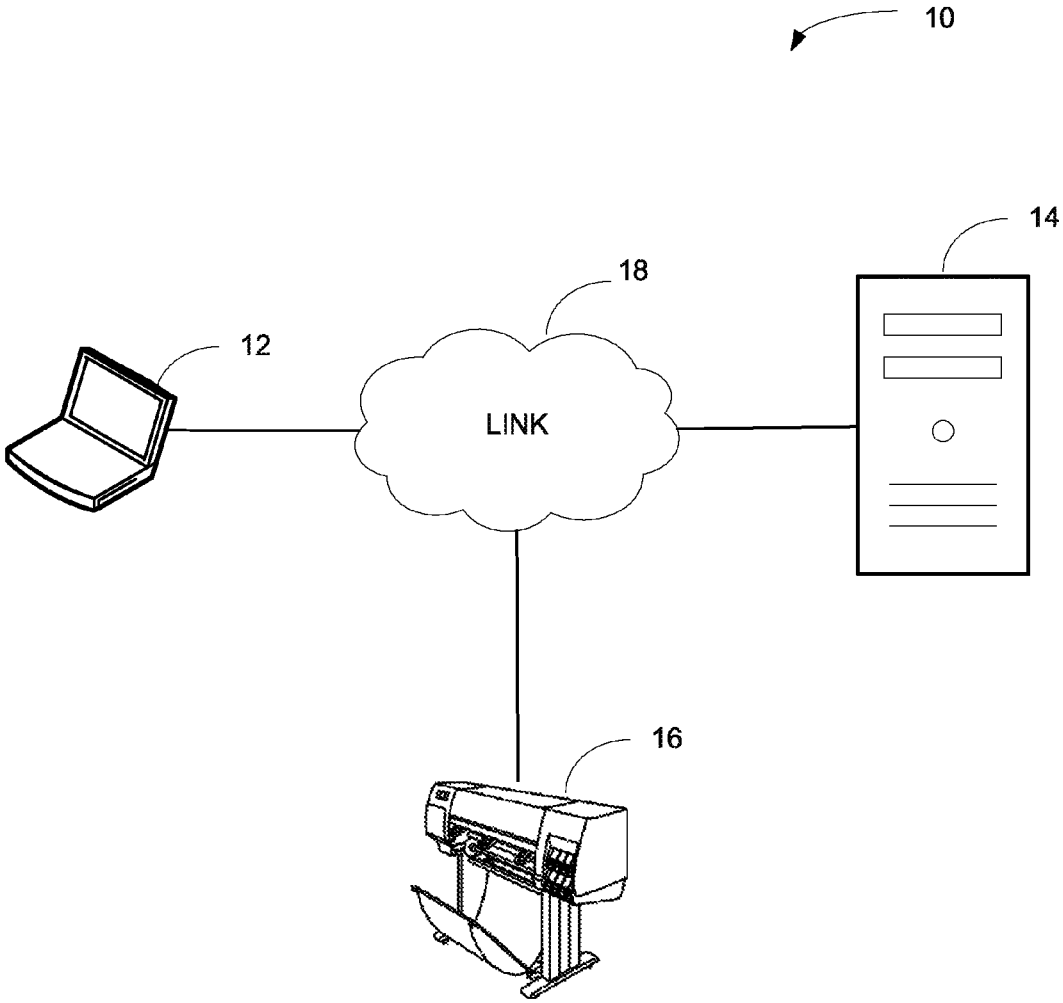
FIG. 1 depicts an example environment in which various embodiments may be implemented.

ENVIRONMENT: FIG. 1 depicts an example environment 10 in which various embodiments may be implemented. Environment 10 is shown to include computing device 12 and server 14 interconnected via link 18. Computing device 12 represents generally any computing device capable of sending network requests to and otherwise communicating with server 14 and/or printer 16. Examples include a desktop computer, laptop computer, digital tablet computer, and the like.

Server 14 represents generally any computing device, or multiple computing devices, capable of receiving and responding to network requests from computing device 12 and/or printer 16 via link 18. As discussed with reference to FIG. 3 below, server 14 may be a server operable to run a raster image processing application and receive a print fulfillment request and/or content from a client 12 and in response cause a printer 16 to produce printed output. Server 14 may be additionally operable to monitor a media supply within the printer 16. In another embodiment, server 14 may be a print management server dedicated to monitoring media supplies and monitoring ink or toner supplies.

Printer 16 represents generally any device operable to receive and process responses to requests to print content from client 12 and/or server 14, and to produce printed output.

Computing device 12, server 14 and printer 16 are interconnected via link 18. Link 18 represents generally one or more of a cable, wireless, fiber optic, or remote connection via a telecommunication link, an infrared link, a radio frequency link, or any other connectors or systems that provide electronic communication. Link 18 may include, at least in part, an intranet, the internet, or a combination of both. Link 18 may also include intermediate proxies, routers, switches, load balancers, and the like. The paths followed by link 18 between computing devices 12 and server 14 as depicted in FIG. 1 represent the logical communication paths between these devices, not necessarily the physical paths between the devices.

Figure 2:
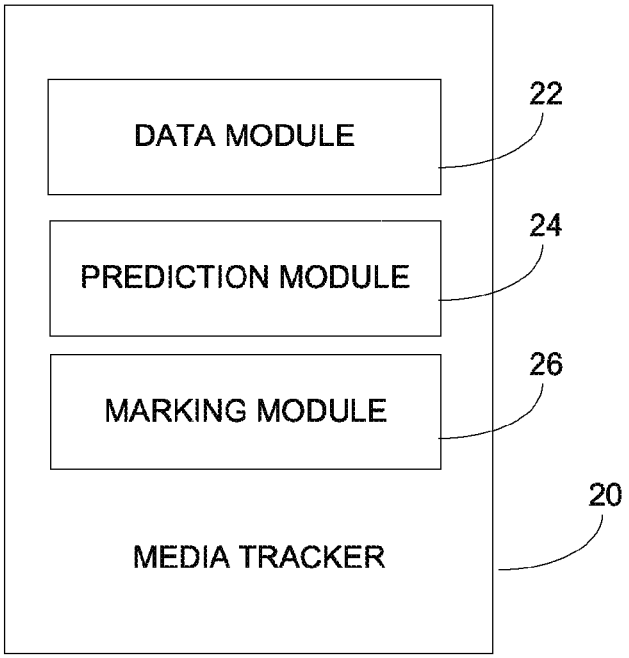
FIG. 2 depicts an example media tracker according to an embodiment.

COMPONENTS: FIG. 2 depicts an example of a media tracker 20. Media tracker 20 represents generally any combination of hardware and programming configured for use to track unused media within a roll. In the example of FIG. 2, media tracker 20 is shown to include a data module 22, a prediction module 24 and a marking module 26.

Data module 22 represents generally any combination of hardware and programming configured to discern or detect data indicative of a first quantity of unused media contained within a roll of media. As used in this specification and the appended claims, a "roll" of unused media is a collection or stock of at least substantially continuous or at least substantially uninterrupted unused media, and includes, but it is not limited to, such a collection or stock in the form of a coil, fold or scroll. As used in this specification and the appended claims, "within a roll of media" includes "in a roll of media" and "on a roll of media", and may be used synonymously with such terms. In an embodiment, the discerned or detected data is received from, or obtained from, a counting apparatus and/or counting module that tracks the quantity of unused media within the roll. The counting apparatus and/or counting module may be comprised within data module 22, or may be external to data module 22. In an embodiment, the discerned or detected data is received from, or obtained, from a memory, the memory comprised within or external to data module 22. In an embodiment, the discerned or detected data indicative of the first quantity of unused media is received, or obtained, from a user via the user's interaction with a user interface. In an example, the user interface may be a printer control panel.

In an embodiment, the discerned or detected data indicative of the first quantity of unused media is received or obtained via a sensor reading of an existing barcode or other machine-readable marking that is printed on the roll, or on a reel, spindle, cylinder or other apparatus that holds the roll. In an embodiment, the reading of a machine-readable marking occurs utilizing a sensor contained within a printer housing. In another embodiment, reading of the machine-readable marking occurs utilizing a sensor contained within a device external to a printer housing, e.g. a hand-held scanning device. In an example, the machine-readable marking may be indicative of an initial roll length and printed upon the roll. In another example, the machine-readable marking may be a marking that was printed on a media and subsequently affixed (e.g. using an adhesive) to a reel, spindle, cylinder or other apparatus that holds the roll.

Prediction module 24 represents generally any combination of hardware and programming configured to, prior to a plot being printed on the roll, discern or determine using the data a second quantity of unused media expected to be in the roll after the plot is printed. As used in this specification and the appended claims, printing of a plot "on the roll" includes printing of the plot on the coil, fold, or scroll portion of a roll, and/or on a portion of the media that is at least substantially contiguous with (i.e. not severed from) a coil, fold, or scroll portion of the roll. In other words, printing of a plot "on the roll" encompasses printing of a plot on a portion of media that is at least substantially contiguous with media that is within the roll, even if at the time of printing that portion is an uncoiled, unfolded or un-scrolled from the rest of the roll. In an embodiment, the second quantity comprises unused media expected to be in the roll after printing of the plot. In another embodiment, the second quantity comprises unused media expected to be in the roll after printing of the plot and the printing of the machine-readable marking discussed in the following paragraph. In an embodiment, the second quantity is discerned or determined via the prediction module performing calculations involving the data utilizing a processor and a memory. In another embodiment, the second quantity is discerned or determined via the prediction module obtaining a value from a pre-existing lookup table stored in a memory.

Marking module 26 represents generally any combination of hardware and programming configured to cause the printing of a machine-readable marking on the roll, along with the plot, the marking being indicative of the second quantity of unused media expected to be in the roll after the plot is printed. As used in this specification and the appended claims, a "machine-readable marking" can be any marking that is configured to encode data and that is readable by a machine. In embodiments, a machine-readable marking may be in the form of a barcode, a QR code, a color code, text or other marking.

In an embodiment, printing of the marking occurs during the same print run as printing of the plot. As used in this specification and the appended claims, a "print run" is a period that follows a printer initialization period, and during which a printing material (e.g. an ink or a toner) is applied to a media. As used in this specification, a "printer initialization period" is a period that precedes a print run and during which the printer brought to a state in which the printing material can be applied to the media. In an embodiment, initializing the printer comprises bringing components within the printer to a temperature that is optimal for printing. In an embodiment, the print run is a period of at least substantially sustained printing temperature within the printer.

In an embodiment, the processing of the machine-readable marking for printing occurs along with processing of the plot. A marking indicative of the second quantity of unused media may be processed utilizing a raster image application that is also used to process the plot. In an embodiment, the marking and the plot may be converted from vector digital information such as a PostScript file into a high resolution raster image. In an embodiment, the marking and the plot are both processed by a raster image application that resides on a server external to the printer. In another embodiment, the marking and the plot are both processed by a raster image application that is firmware residing on a printer.

In an embodiment, the marking and the plot may be processed for printing by a common processor. In another embodiment, the marking indicative is processed utilizing a first processor that is separate from a second processor that is used to process the plot. For example, a barcode may be processed utilizing a first processor included within a printer, and the plot processed utilizing a second processor included within a server or other computing device external to the printer. In an embodiment the second processor is included within a computing device that is external to a printer and that is dedicated to processing plots and other digital files for printing. In another embodiment, the second processor is contained within a computing device that is external to a printer and hosts applications other than print applications. In an embodiment the second processor is included within a computing device that is external to a printer and that is dedicated to processing plots and other digital files for printing. In an embodiment, the marking is processed at a printer and the plot is processed utilizing a raster image processing application that runs external to the printer.

In an embodiment, the marking module is configured to cause severing of used media between the plot and the marking, leaving a portion of the media that contains the machine-readable marking on the roll. The marking module may send a signal to a severing device (e.g. a media cutter or knife) located within the printer to cause the severing.

The marking module may be additionally configured to cause removing of the roll from the printer. The marking module may send a message to a user via a printer control panel or other user interface, the message instructing the user to remove the roll from the printer. In an example, removing of the roll from the printer may be a removing as part of a roll change. In another example, removing of the roll from the printer may comprise moving the roll out of a print zone (such that the roll is still attached to or incorporated within the printer) rather than completely removing the roll from a printer. In an embodiment, a multi-roll accessory may rotate a roll in & out of a print zone.

In an embodiment, the marking module is additionally configured to cause a reading of the marking upon a reinstallation of the roll. In this embodiment upon reinstallation of the roll into the printer the marking is recognized and read by a sensor. An unused media tracking counter may be updated with the information as to the second quantity of unused media expected to be in the roll after the plot is printed.

In an embodiment, an instruction to print the machine-readable marking is received before printing of the plot is completed. In an embodiment, before printing of the plot is completed, an instruction is received that the plot is a last of a plurality of plots to be printed prior to a removal of the roll. In an embodiment, the instruction is received prior to the printing of the plot. The instruction may be received from a user via the user's interaction with a raster image processor application, a print driver, or other software application running on a computing device that is connected to a printer. In an embodiment, the instruction is received from a user via the user's interaction with a graphic user interface that is part of the raster image processing application, print driver, or other software application. User interaction with the graphic user interface may be via a mouse, keyboard, touchpad or otherwise.

Figure 3:
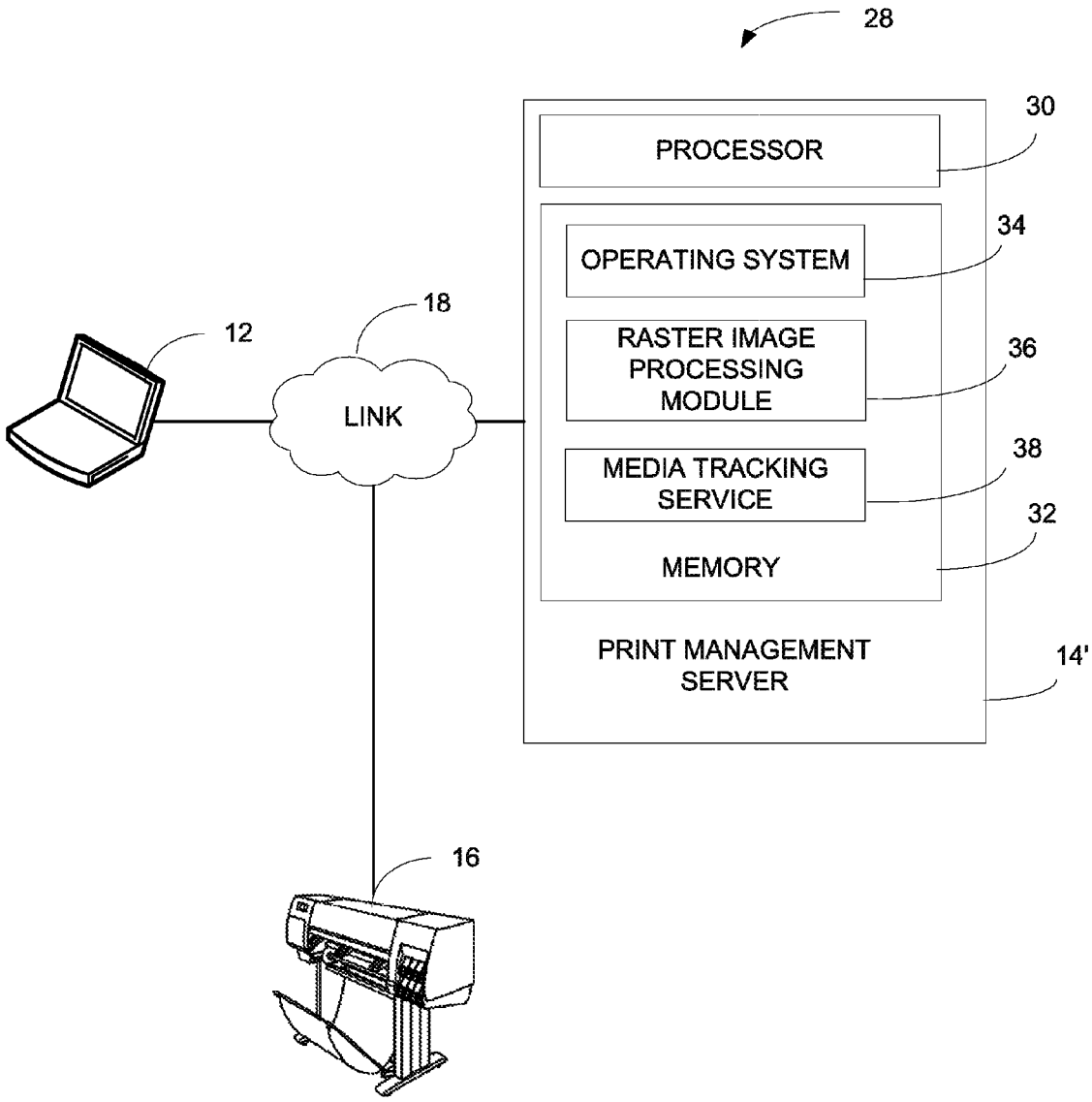
FIGS. 3-4 depict implementations of the media tracker of FIG. 2 according to embodiments.

Media tracker 20 may be implemented in a number of environments, such as environment 28 of FIG. 3. Environment 28 includes a host computer 12, a print management server 14' and a printer 16, interconnected via link 18.

Host computing device 12 represents generally any computing device capable of sending print jobs to and communicating with a print management server 14' and/or a printer 16, and receiving information relating to the received print jobs and the printed output from the print management server 14' and/or printer 16.

Printer 16 represents generally a computing device capable of receiving print jobs from host computing device 12, producing printed output from the print jobs and communicating information relating to the received print jobs and/or the printed output back to the host 12. In particular, printer 16 utilizes imaging material such as ink or toner to form a desired image on a print media, the print media supplied by a media roll. As used in this specification and the appended claims, "print media" and "media" are used synonymously. In embodiments the media roll may be positioned within or adjacent to a housing of the printer 16.

In an embodiment, a print management server 14' is shown to include processor 30 and a memory 32. Processor 30 represents generally any device capable of executing program instructions stored in memory 32. Memory 32 represents generally any memory configured to store program instructions and other data. Memory 32 is shown to include an operating system 34, raster image processing module 36 and media tracking service 38. The processor 30 may represent multiple processors, and the memory 32 may represent multiple memories. Operating system 34 represents generally any software platform on top of which other programs or applications such as the raster image processing module 36 and media tracking service 38 run. Examples include Linux® and Microsoft Windows®. Raster image processing module 36 represents generally any combination of hardware and software capable of converting digital information about fonts and graphics that describes the appearance of a plot (e.g. information from a drawing or desktop publishing application) and translating that information into an image composed of individual dots that the printer can output. In embodiments, a raster image processing module 36 may perform additional tasks, such as composing page layouts, scaling, calibrating printer colors, and/or managing a queue of print jobs.

Media tracking service 38 in combination with operating system 34 represent generally any combination of hardware and programming that, when executed, implements the functionality of the media tracker 20 of FIG. 2. In particular, media tracking service 38, when executed by processor 30, is responsible for tracking unused media within a roll. Data is discerned, the data indicative of a first quantity of unused media contained within a roll of media. Prior to a plot being printed on the roll, a second quantity of unused media expected to be in the roll after the plot is printed is discerned using the data. Media tracking service 38 causes printing of a machine-readable marking, along with the plot, on the roll, the marking being indicative of the second quantity of unused media expected to be in the roll after the plot is printed. In an embodiment, media tracking service 38 causes severing of used media between the plot and the marking, the severing leaving a portion of the media that contains the machine-readable marking on the roll. In an embodiment, media tracking service 38 causes removal of the roll from the printer, and a reading of the marking upon a reinstallation of the roll into the printer. In this embodiment upon reinstallation of the roll into the printer the marking is recognized and read by a sensor, the marking providing information as to the second quantity.

Figure 4:
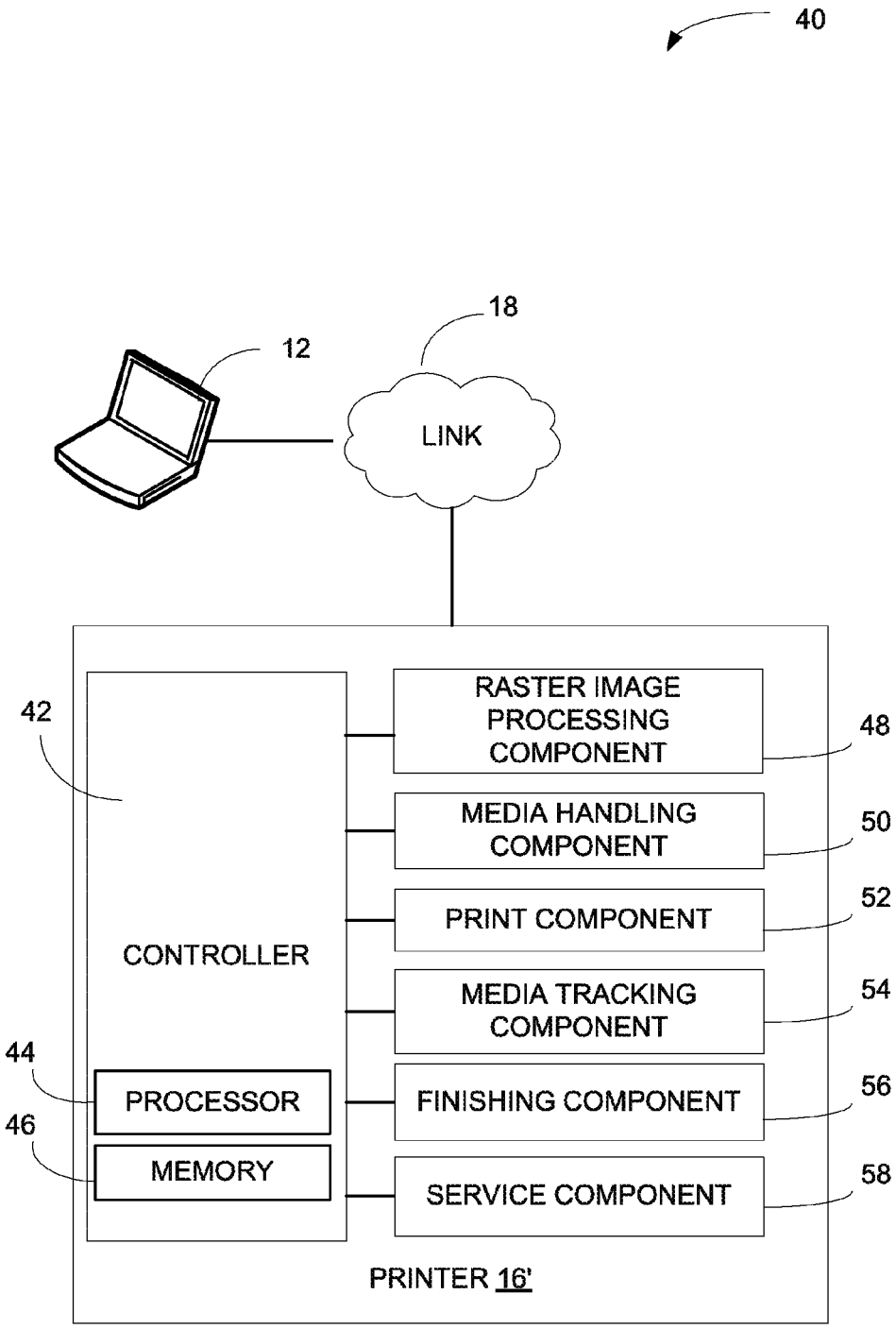

Moving to FIG. 4, an implementation is depicted in which some of the actions taken by print management server 14' in FIG. 3 are now taken by printer 16'. In particular, a media tracking component 54 residing on the printer 16' may enable tracking of unused media with a media roll according to an embodiment of the disclosure. Environment 40 includes host computing device 12 and printer 16' interconnected via link 18. Host computing device 12 represents generally any computing device capable of sending print jobs to and communicating with printer 16', and receiving information relating to the received print jobs and the printed output from printer 16'. Printer 16' represents generally a computing device capable of receiving print jobs from host computing device 12, producing printed output from the print jobs and communicating information relating to the received print jobs and/or the printed output back to the host 12. Printer 16' is shown to include a raster image processing component 48, media handling component 50, a print component 52, a media tracking component 54, a finishing component 56, a service component 58, and a controller 42.

Raster image processing module 48 represents generally any combination of hardware and software capable of converting digital information about fonts and graphics that describes the appearance of a plot (e.g. information from a drawing or desktop publishing application) and translating that information into an image composed of individual dots that printer 16' can output. Media handling component 50 represents generally any combination of hardware and programming capable of transporting print media through the printer 16'. The print media is supplied for printing via a media roll, the media roll positioned within, or adjacent, to a housing of printer 16' during printing operations. Print component 52 represents generally any combination of elements capable of being utilized to form desired images on media. In a given example, print component 52 may include a fluid ejection mechanism, each fluid ejection mechanism including multiple printheads configured to dispense ink or other fluid. As used in this specification and the appended claims, "printhead" includes a mechanism having a plurality of nozzles through which ink or other fluid is ejected. Examples of printheads are drop-on-demand inkjet printheads, thermo resistive printheads, piezo and resistive printheads. Some printheads may be part of a cartridge which also stores the fluid to be dispensed. Other printheads are standalone and are supplied with fluid by an off-axis ink supply. In other embodiments, exemplary print component 52 may include a laser printing mechanism or other type of printing mechanism. Finishing component 56 represents generally any combination of hardware and programming capable of performing a finishing operation on media. Such finishing operations include cutting, folding, laminating or any other action that affects the physical nature of the print media. Service component 58 represents generally any combination of elements capable of being utilized to service print component 52. Where, for example, print component 52 includes a printhead, service component 58 may be configured to function as a spittoon and an alignment calibrator.

Media tracking component 54 represents generally any programming, that, when executed, implements the functionality of the media tracker module of FIG. 2. In particular, media tracking component 54, when executed by controller 42, is responsible for tracking unused media within a roll. Data indicative of a first quantity of unused media contained within a roll of media is detected. A second quantity of unused media expected to be in the roll after the plot is printed is determined using the data, the determining to occur prior to the plot being printed on the roll. Media tracking component 54 causes printing of a machine-readable marking, along with the plot, on the roll. The marking is indicative of the second quantity of unused media. In an embodiment, in combination with finishing component 56, severing of used media between the plot and the marking is caused, the severing leaving a portion of the media that contains the machine-readable marking on the roll.

As used in this specification, controller 42 represents generally any combination of elements capable of coordinating the operation of components 48, 50, 52, 54, 56 and 58. In a given implementation, controller 42 includes a processor 44 and a memory 46. The processor 44 may represent multiple processors, and the memory 46 may represent multiple memories. In an embodiment, the controller 42 may include a number of software components that are stored in a computer-readable medium, such as memory 46, and are executable by processor 44. In this respect, the term "executable" includes a program file that is in a form that can be directly (e.g. machine code) or indirectly (e.g. source code that is to be compiled) performed by the processor 44. An executable program may be stored in any portion or component of memory 46. In the foregoing discussion, various components were described as combinations of hardware and programming. Such components may be implemented in a number of fashions. In one example, the programming may be processor executable instructions stored on tangible memory media and the hardware may include a processor for executing those instructions. Thus, certain elements operating on the same device may share a common processor and common memory media.

Figure 5:
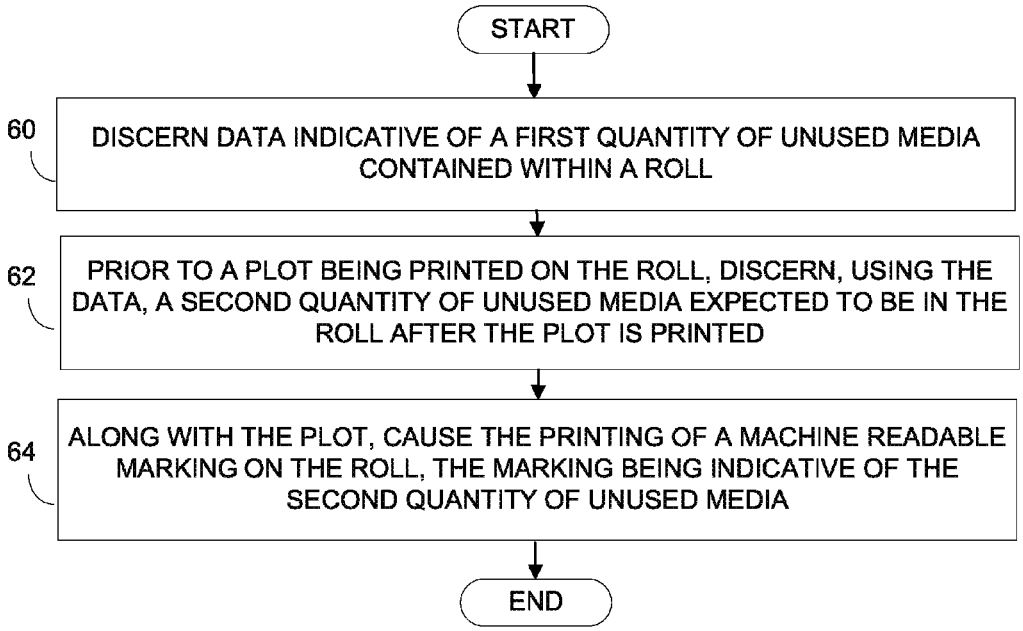
FIGS. 5-6 are flow diagrams depicting steps taken to implement various embodiments.
Figure 6:
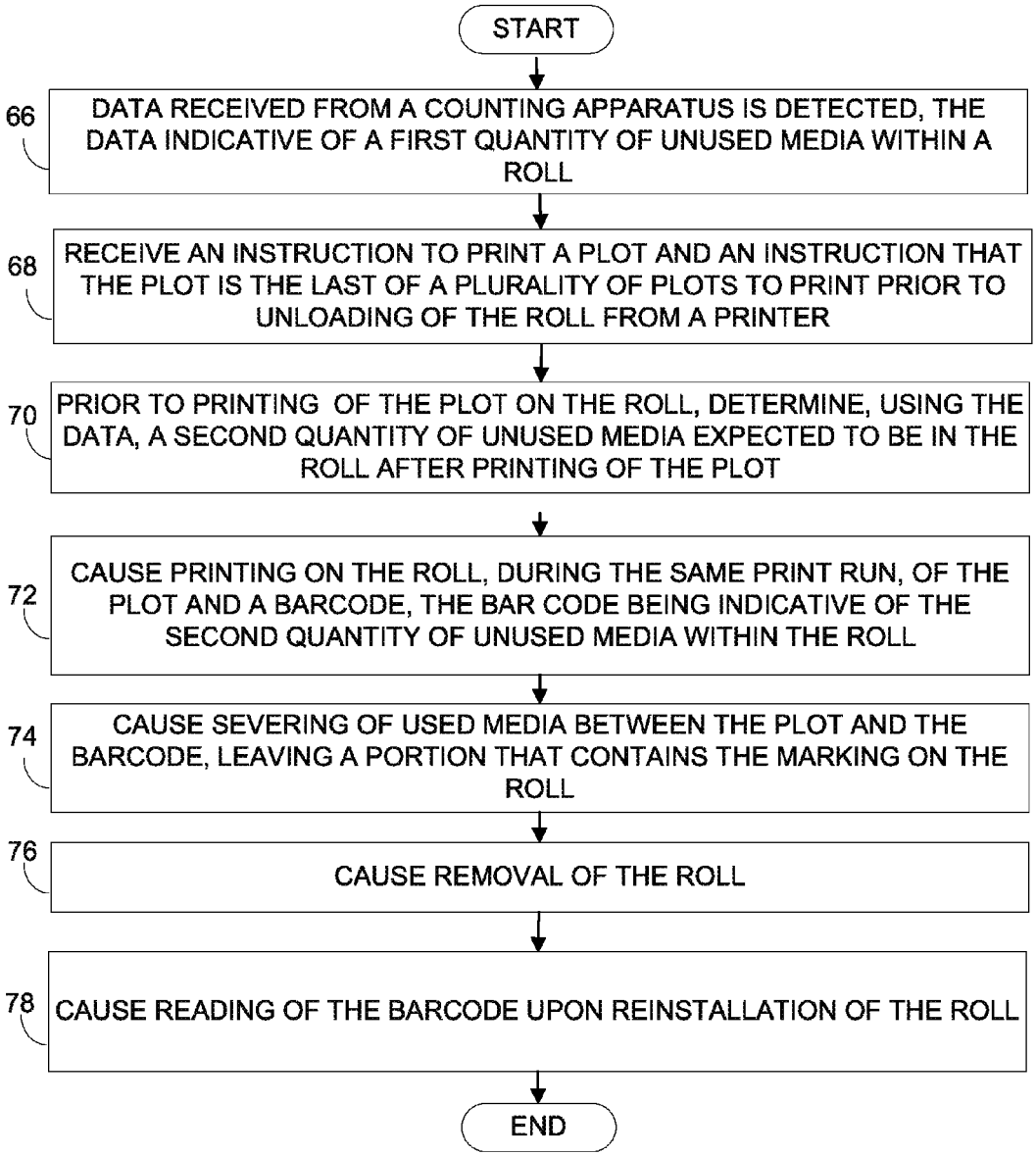

OPERATION: FIGS. 5 and 6 are example flow diagrams of steps taken to implement a method to track unused media in accordance with an embodiment. In discussing FIGS. 5 and 6, reference may be made to the diagrams of FIGS. 1-4 to provide contextual examples. Implementation, however, is not limited to those examples.

Starting with FIG. 5, data indicative of a first quantity of unused media contained within a roll is discerned (block 60). Referring back to FIG. 2, the data module 22 may be responsible for implementing block 60. In an embodiment, the discerned data is received from, or obtained from, a counting apparatus and/or counting module that has information as to the quantity of unused media within the roll. In another embodiment, the discerned data indicative of the first quantity of unused media is received or obtained via a sensor reading of an existing barcode or other machine-readable marking. The existing machine-readable marking may be located on the roll, or on a reel, spindle, cylinder or other apparatus that holds the roll.

Continuing with the flow diagram of FIG. 5, prior to a plot being printed on the roll, a second quantity of unused media expected to be in the roll after the plot is printed is discerned, using the data (block 62). Referring back to FIG. 2, the prediction module 24 may be responsible for implementing block 62. In an embodiment, the second quantity is discerned via the prediction module performing calculations involving the data, utilizing a processor and a memory.

Continuing with the flow diagram of FIG. 5, printing of a machine-readable marking on the roll, along with the plot, is caused, the marking being indicative of the second quantity of unused media (block 64). Referring back to FIG. 2, the marking module 26 may be responsible for implementing block 64.

Moving on to FIG. 6, in a particular implementation, data received from a counting apparatus is detected, the data indicative of a first quantity of unused media within a roll (block 66). Referring back to FIG. 2, the data module 22 may be responsible for implementing block 66. In another embodiment the data is obtained from memory, having been previously sent to memory from the counting apparatus.

Continuing with the flow diagram of FIG. 6, an instruction to print a plot, and an instruction that the plot is the last of a plurality of plots to print prior to unloading of the roll from a printer, are received (block 68). Referring back to FIG. 2, the marking module 26 may be responsible for implementing block 68. In an embodiment, the instruction is received from a user via the user's interaction with a raster image processor application, a print driver, or other software application running on a computing device that is connected to a printer. In an embodiment, the instruction is received from a user via a user's interaction with a touchpad or other user interface of a printer.

Continuing with the flow diagram of FIG. 6, prior to printing of the plot on the roll, a second quantity of unused media expected to be in the roll after printing of the plot is determined using the data (block 70). Referring back to FIG. 2, the prediction module 24 may be responsible for implementing block 70. In an embodiment, the second quantity is discerned via the prediction module obtaining a value from a pre-existing lookup table stored in a memory.

Continuing with the flow diagram of FIG. 6, printing on the roll, during the same print run, of the plot and a barcode is caused, the barcode being indicative of the second quantity of unused media within the roll (block 72). Referring back to FIG. 2, the marking module 26 may be responsible for implementing block 72. In another embodiment, the machine-readable marking may be in the form of a QR code, a color code, text or other marking.

Continuing with the flow diagram of FIG. 6, severing of used media between the plot and the barcode is caused, leaving a portion that contains the marking on the roll (block 74). Referring back to FIG. 2, the marking module 26 may be responsible for implementing block 74. In an embodiment, a signal is sent to a severing device (e.g. a media cutter or knife) located within the printer to cause the severing.

Continuing with the flow diagram of FIG. 6, removal of the roll is caused (block 76). Referring back to FIG. 2, the marking module 26 may be responsible for implementing block 76. In an embodiment, a message is sent to a user via a printer control panel or other user interface, the message instructing the user to remove the roll from the printer.

Continuing with the flow diagram of FIG. 6, reading of the barcode is caused upon reinstallation of the roll (block 78). Referring back to FIG. 2, the marking module 26 may be responsible for implementing block 78. In an embodiment upon reinstallation of the roll into the printer the marking is recognized and read by a sensor, and a counting apparatus or counting module is updated with information as to the second quantity of unused media expected to be in the roll after printing of the plot.

EXAMPLES

The diagrams of FIGS. 7*a*, 7*b*, 7*c*, 7*d*, 7*e*, 8, and 9 provide example implementations of a method and system to track unused media.

FIGS. 7*a*, 7*b*, 7*c*, 7*d*, and 7*e* illustrate an example of tracking of unused media within a roll according to an embodiment of this disclosure. Beginning with FIG. 7*a*, data 80 indicative of a first quantity of unused media contained within a roll 82 of media is discerned. In this example, the discerned data 80 is received or obtained via a sensor 84 reading a first machine-readable marking (not shown) that is printed on a reel 86 that holds the roll 82. In an example, the sensor 84 is contained within the housing of a printer 88, the printer configured to hold the roll 82. A plot 90 (FIG. 7*b*) to be printed is received from a host computer 92. Prior to the plot 90 being printed on the roll 82, it is discerned using the data 80 a second quantity of unused media expected to be in the roll 82 after the plot 90 is printed. In this example, the second quantity is discerned utilizing a value from a pre-existing lookup table (not shown) that is stored in memory 94 within the printer 88.

Figure 7A:
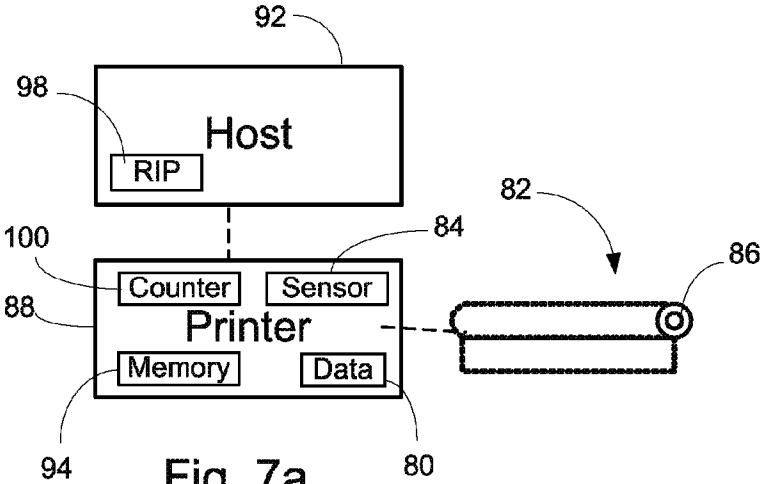
FIGS. 7*a*, 7*b*, 7*c*, 7*d*, 7*e*, 8, and 9 depict example implementations of the disclosed method and system to track unused media.
Figure 7B:
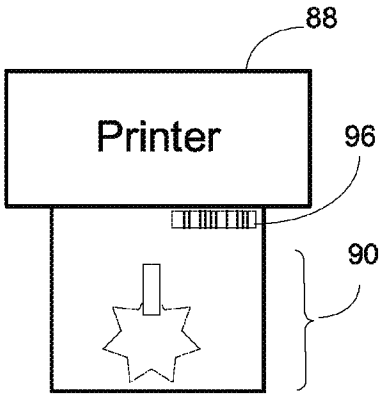

Moving to FIG. 7*b*, printing of a second machine-readable marking 96 on the roll 82, along with printing of the plot 90, is caused. The second machine-readable marking 96 is indicative of the second quantity of unused media expected to be in the roll 82 after the plot 90 is printed. In this example the second machine-readable marking 96 is a barcode, and printing of that marking occurs during the same print run as printing of the plot 90. In this example, the second machine readable marking 96 and the plot 90 are both processed by a raster image application 98 that is installed on and runs on the host computer 92 (FIG. 7*a*).

Figure 7C:
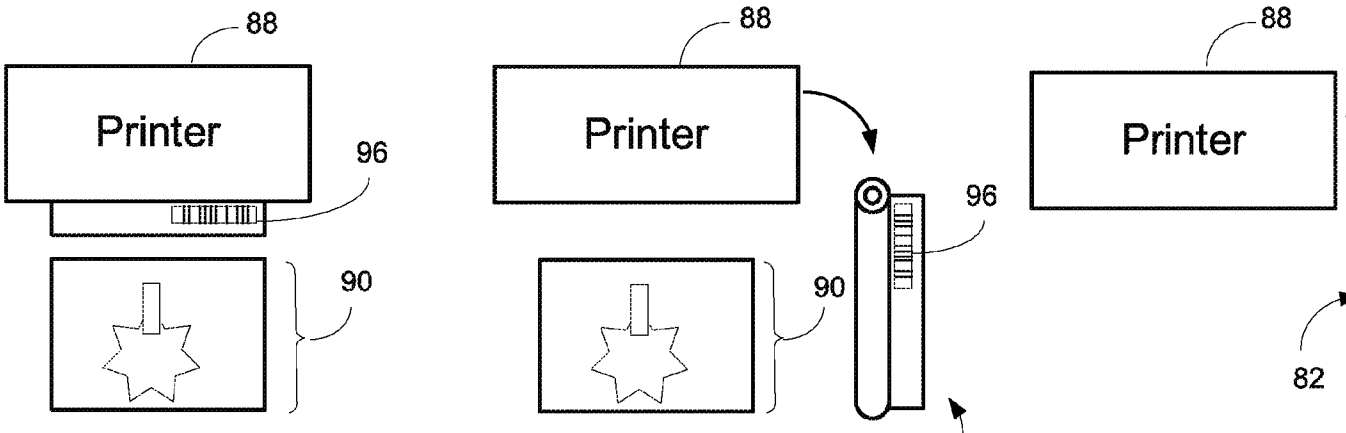

Moving to FIG. 7*c*, severing of used media between the plot 90 and the second machine-readable marking 96 is caused, leaving a portion of the media that contains the marking 96 on the roll 82 (FIG. 7*a*). Severing may be caused by the sending of a signal to a cutting apparatus (not shown) positioned within or adjacent to the printer 88.

Figure 7D:
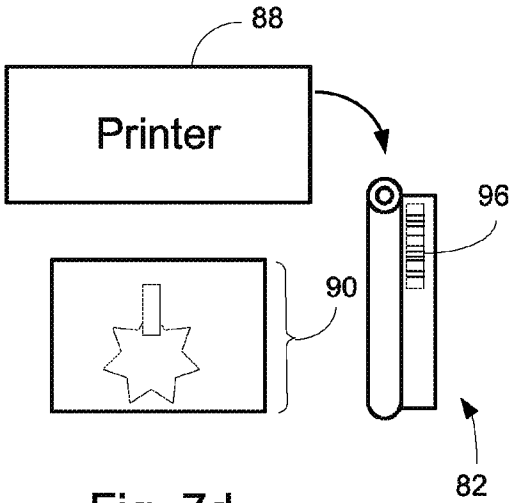

Moving to FIG. 7*d*, removal of the roll 82 from the printer 92 may be caused. For example, a message may be sent to a user via a printer control panel, via a monitor connected to the host computer, or via another user interface, the message instructing the user to remove the roll 82 from the printer 88.

Figure 7E:
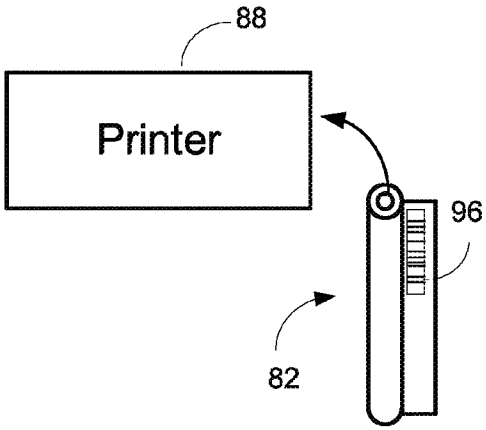

Moving to FIG. 7*e*, upon subsequent reinstallation of the roll 82, the second machine-readable marking 96 may be recognized and read by the sensor 84 (FIG. 7*a*). A media tracking counter 100 (FIG. 7*a*) may be updated with the information (as to the second quantity of unused media expected to be in the roll 82 after the plot 90 is printed) communicated by the second machine-readable marking 96.

Figure 8:
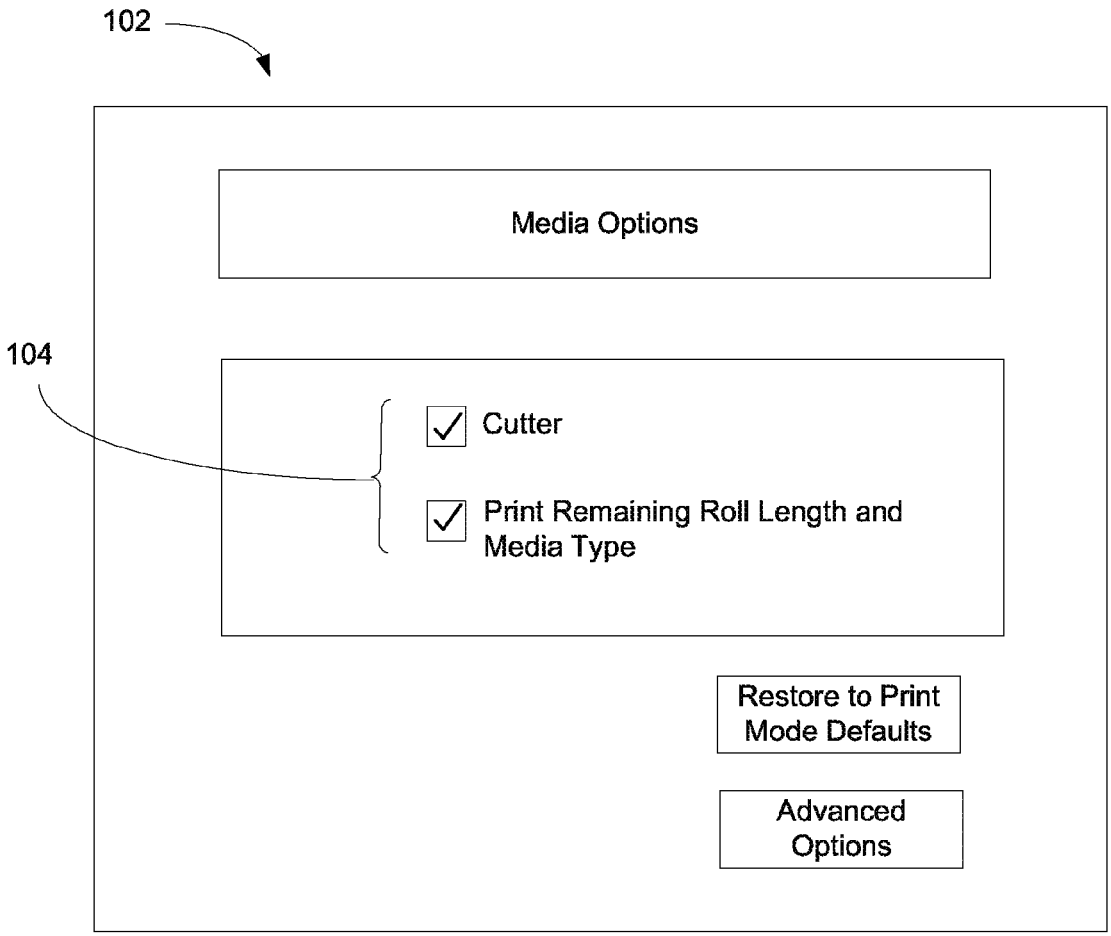

FIG. 8 is an example screen shot of a user interface according to an embodiment of the disclosure. In this example, instructions 104 are received from a user, via the user's interaction with a graphic user interface 102. Referring back to FIG. 7*a*, the graphic user interface 102 may be a part of the raster image processing application 98 that is installed on host computer 92. Referring back to FIG. 7*b*, the instructions 104 may cause printing of the second machine-readable marking 96 that is indicative of the quantity of unused media that is expected to be on the roll 82 after the plot 90 is printed. Referring back to FIG. 7*c*, the instructions 104 may also cause a cutting of the media between the plot 90 and the second machine-readable marking 96.

Figure 9:
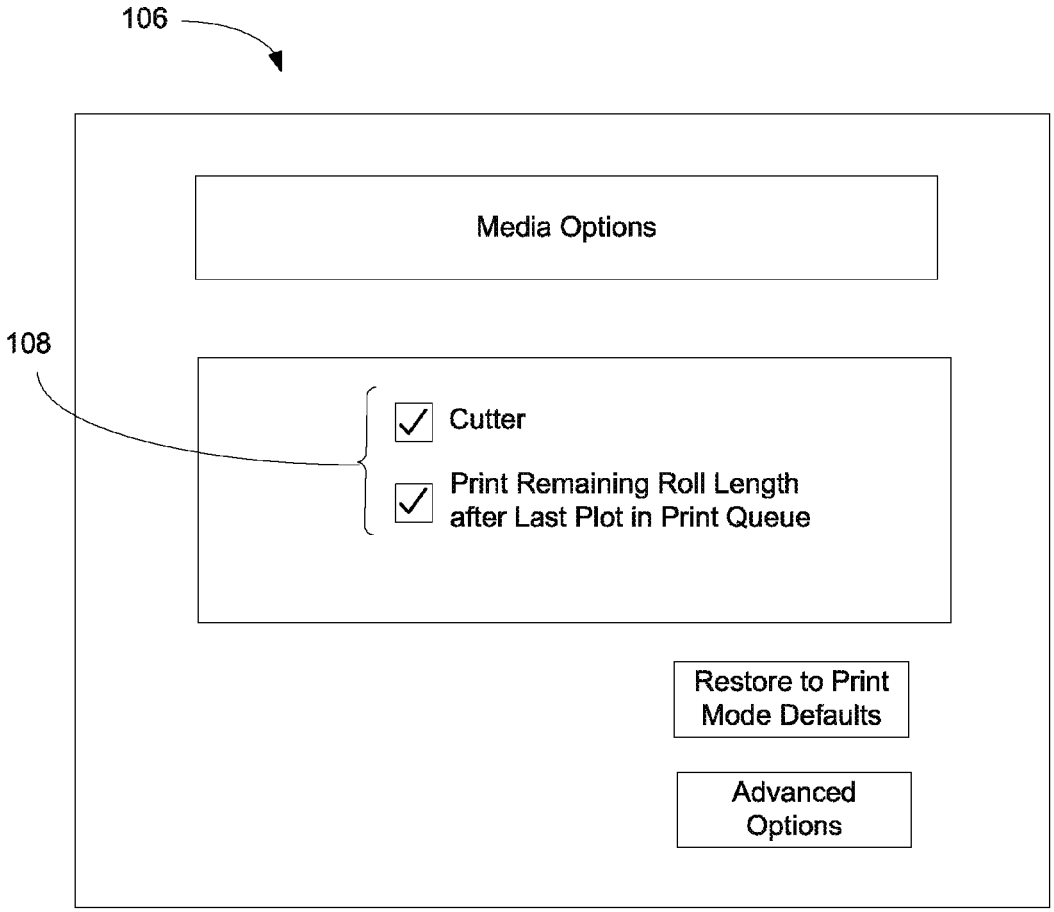

FIG. 9 is another example screen shot of a user interface according to an embodiment of the disclosure. Instructions 108 are received from a user, via the user's interaction with a graphic user interface 106. In an example, instructions 108 are received, along with a print job comprising ten banner plots, at a printer. Along with printing of the ten banner plots, the printer is caused to print a machine-readable marking after the tenth plot. The marking is indicative of the amount of unused media remaining in the roll after printing of the tenth plot. Instructions 108 also cause a cutting of the media between the printed tenth plot and the printed machine-readable marking.

CONCLUSION

The diagram of FIG. 1 is used to depict an example environment in which various embodiments may be implemented. Implementation, however, is not so limited. FIGS. 2-4 show the architecture, functionality, and operation of various embodiments. Various components illustrated in FIGS. 2-4 are defined at least in part as programs. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function(s).

Also, the present disclosure may be embodied in any computing device-readable media for use by or in connection with an instruction execution system such as a computing device/processor based system or an ASIC (Application Specific Integrated Circuit) or other system that can fetch or obtain the logic from computing device-readable media and execute the instructions contained therein. "Computing device-readable media" can be any media that can contain, store, or maintain programs and data for use by or in connection with the instruction execution system. Computing device readable media can comprise any one of many physical media such as, for example, electronic, magnetic, optical, electromagnetic, or semiconductor media. More specific examples of suitable computing device-readable media include, but are not limited to, a portable magnetic computing device diskette such as floppy diskettes or hard drives, a random access memory (RAM), a read-only memory (ROM), an erasable programmable read-only memory, or a portable compact disc.

Although the flow diagrams of FIGS. 5 and 6 show specific orders of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present disclosure.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method to track unused media within a roll, the method comprising:

discerning data indicative of a first quantity of unused media contained within the roll;

receiving an instruction to print a plot on the roll, and receiving an instruction that the plot is a last of a plurality of plots to be printed on the roll;

prior to the plot being printed on the roll, predicting, using the data, a second quantity of unused media expected to be in the roll after the plot is printed;

receiving, before printing the plot is completed, an instruction to print a machine-readable marking on the roll after the last of the plurality of plots is printed, the marking indicative of the second quantity of unused media;

processing the marking for printing along with processing the plot;

during a same print run as printing the plot, printing the marking on the roll after the last of the plurality of plots is printed.

2. The method of claim 1, further comprising, after printing the marking, severing used media between the plot and the marking, leaving a portion that contains the marking on the roll.

3. The method of claim 1, wherein receiving the instruction that the plot is a last of a plurality of plots to be printed includes receiving the instruction before printing the plot is completed.

4. The method of claim 1, wherein receiving the instruction that the plot is a last of a plurality of plots to be printed includes receiving the instruction prior to printing the plot.

5. The method of claim 1, wherein the second quantity comprises unused media expected to be in the roll after printing of the plot and printing of the marking.

6. The method of claim 1, wherein receiving the instruction to print a machine-readable marking on the roll after the last of the plurality of plots is printed includes receiving the instruction from a user via a user interface.

7. The method of claim 1, wherein receiving the instruction that the plot is a last of a plurality of plots to be printed includes receiving the instruction from a user via a user interface.

8. A system comprising a processor and a memory, the processor being configured to execute instructions stored in the memory, wherein the memory stores instructions in the form of a data module, a prediction module, and a marking module:

the data module configured to discern data indicative of a first quantity of unused media contained within a roll;

the marking module configured to receive an instruction from a user to print a plot on the roll, and receive an instruction from the user that the plot is a last of a plurality of plots to be printed on the roll;

the prediction module configured to, prior to the plot being printed on the roll, predict, using the data, a second quantity of unused media expected to be in the roll after the plot is printed;

the marking module configured to, before printing the plot is completed, receive an instruction from the user to print a machine-readable marking on the roll after the last of the plurality of plots is printed, the marking indicative of the second quantity of unused media;

the marking module configured to process the marking for printing along with processing the plot and, during a same print run as printing the plot, print the marking on the roll after the last of the plurality of plots is printed.

9. The system of claim 8, wherein the marking module is configured to, before printing the plot is completed, receive the instruction that the plot is a last of a plurality of plots to be printed.

10. The system of claim 8, wherein the marking module is configured to, prior to printing the plot, receive the instruction that the plot is a last of a plurality of plots to be printed.

11. The system of claim 8, wherein the marking module is further configured to, after the marking is printed, signal severing of used media between the plot and the marking to leave a portion that contains the marking on the roll.

12. The system of claim 8, wherein the second quantity comprises unused media expected to be in the roll after the plot and the marking are printed.

13. The system of claim 8, further comprising:

a user interface, wherein the instruction that the plot is a last of a plurality of plots to be printed is received from the user via the user interface, wherein the instruction to print a machine-readable marking on the roll after the last of the plurality of plots is printed is received from the user via the user interface.

14. A non-transitory computer readable medium storing computer executable instructions that when executed implement a method comprising:

detecting data indicative of a first quantity of unused media contained within a roll;

receiving a print job comprising a plurality of plots to be printed on the roll;

receiving, with the print job, an instruction to print a machine-readable marking on the roll after a last plot in a print queue is printed, the marking indicative of a second quantity of unused media expected to be in the roll after the last plot and the marking are printed;

prior to the plots being printed on the roll, determining, using the data, the second quantity of unused media expected to be in the roll after the last plot and the marking are printed;

processing the marking for printing along with processing the print job;

during a same print run as printing the print job, printing the marking on the roll after the last plot is printed.

15. The medium of claim 14, wherein the computer executable instructions when executed implement the method further comprising receiving, before printing of the last plot is completed, an instruction that the last plot is a last of a plurality of plots to be printed prior to removal of the roll.

16. The medium of claim 14, wherein the computer executable instructions when executed implement the method further comprising receiving, prior to printing the last plot, an instruction that the last plot is a last of a plurality of plots to be printed prior to removal of the roll.

17. The medium of claim 14, wherein the computer executable instructions when executed implement the method further comprising wherein receiving the instruction to print a machine-readable marking on the roll after a last plot in a print queue is printed includes receiving the instruction from a user via a user interface.

18. The medium of claim 14, wherein the computer executable instructions when executed implement the method further comprising processing the marking at a printer and processing the print job utilizing a raster image processing application that runs external to the printer.

19. The medium of claim 14, wherein the computer executable instructions when executed implement the method further comprising processing the marking utilizing a raster image processing application.

20. The medium of claim 14, wherein the computer executable instructions when executed implement the method further comprising:

after printing the marking, severing used media between the plot and the marking to leave a portion that contains the marking on the roll.

* * * * *